US010512813B1

(12) United States Patent
Hayward

(10) Patent No.: US 10,512,813 B1
(45) Date of Patent: Dec. 24, 2019

(54) MULTI-USER MOBILE BAND STATION

(71) Applicant: Mike Hayward, Bettendorf, IA (US)

(72) Inventor: Mike Hayward, Bettendorf, IA (US)

( * ) Notice: Subject to any disclaimer, the term of this patent is extended or adjusted under 35 U.S.C. 154(b) by 0 days.

(21) Appl. No.: 16/024,255

(22) Filed: Jun. 29, 2018

Related U.S. Application Data

(60) Provisional application No. 62/526,604, filed on Jun. 29, 2017.

(51) Int. Cl.

| | |
|---|---|
| ***A63B 21/04*** | (2006.01) |
| ***A63B 21/055*** | (2006.01) |
| ***A63B 23/12*** | (2006.01) |
| ***A63B 23/04*** | (2006.01) |
| ***A63B 23/08*** | (2006.01) |
| ***A63B 23/02*** | (2006.01) |
| ***A63B 23/14*** | (2006.01) |

(52) U.S. Cl.
CPC ..... *A63B 21/0442* (2013.01); *A63B 21/0557* (2013.01); *A63B 23/0205* (2013.01); *A63B 23/0405* (2013.01); *A63B 23/08* (2013.01); *A63B 23/1209* (2013.01); *A63B 23/1281* (2013.01); *A63B 23/14* (2013.01); *A63B 2023/0411* (2013.01); *A63B 2225/107* (2013.01)

(58) Field of Classification Search
CPC ..... A63B 21/02–0557; A63B 69/004; A63B 2024/0081; A63B 69/24; A63B 69/205; A63B 69/206; A63B 69/208
See application file for complete search history.

(56) References Cited

U.S. PATENT DOCUMENTS

| | | | | |
|---|---|---|---|---|
| 4,072,309 | A * | 2/1978 | Wilson | A63B 21/0023 482/104 |
| 5,087,035 | A * | 2/1992 | Podd, III | A63B 21/4001 273/453 |
| 7,086,997 | B1 * | 8/2006 | Fields | A63B 69/004 482/83 |
| 7,815,556 | B1 * | 10/2010 | Bauer | A63B 21/0552 482/121 |
| 2003/0032524 | A1 * | 2/2003 | Lamar | A63B 21/00 482/8 |
| 2004/0072663 | A1 * | 4/2004 | Ardito, III | A63B 21/04 482/121 |
| 2004/0176222 | A1 * | 9/2004 | Mitchell | A63B 69/004 482/83 |
| 2005/0153794 | A1 * | 7/2005 | LaPointe | A63B 69/0084 473/429 |
| 2006/0258519 | A1 * | 11/2006 | Ardito, III | A63B 21/0004 482/121 |
| 2007/0197351 | A1 * | 8/2007 | Gonzalez | A63B 69/004 482/83 |

(Continued)

*Primary Examiner* — Nyca T Nguyen
(74) *Attorney, Agent, or Firm* — Hamilton IP Law, PC; Jay R. Hamilton; Charles A. Damschen

(57) ABSTRACT

A multi-user mobile band station is configured of a central support stand with multiple attachment bars and a base with multiple horizontal receivers. At least of one exercise band can be attached or detached alone the length of the attachment bar located at the central support stand allowing the user to adjust the height of the exercise band. In addition, each attachment bar positions around the perimeter of the central support stand allowing multiple users to exercise at the same time without conflicting each other.

20 Claims, 11 Drawing Sheets

(56) References Cited

U.S. PATENT DOCUMENTS

| | | | | |
|---|---|---|---|---|
| 2009/0215594 | A1* | 8/2009 | Panaiotov | A63B 21/0552<br>482/130 |
| 2011/0251025 | A1* | 10/2011 | Harker | A63B 21/0442<br>482/91 |
| 2013/0213917 | A1* | 8/2013 | Rios Garcia Prieto | A63B 3/00<br>211/182 |
| 2013/0337983 | A1* | 12/2013 | McTavish | A63B 7/00<br>482/139 |
| 2015/0182772 | A1* | 7/2015 | Matthew | A63B 21/00047<br>482/129 |
| 2015/0231470 | A1* | 8/2015 | Kanner | A63B 69/0002<br>473/417 |
| 2015/0251039 | A1* | 9/2015 | Mikulski | A63B 21/0442<br>482/126 |
| 2017/0043234 | A1* | 2/2017 | Bourgeois | A63B 69/0002 |

* cited by examiner

MULTI-USER MOBILE BAND STATION

CROSS REFERENCE TO RELATED APPLICATIONS

The present non-provisional utility patent application claims priority from provisional U.S. Pat. App. No. 62/526,604 filed on Jun. 29, 2017, which is incorporated by reference herein in its entirety.

FIELD OF THE INVENTION

The present disclosure relates exercise equipment and methods of use and particularly for a multi-user mobile band station which allows multiple users to connect multiple exercise bands to a single machine, for individual or simultaneous exercise, as shown and disclosed herein.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION—BRIEF DESCRIPTION OF DRAWINGS

DETAILED DESCRIPTION - LISTING OF ELEMENTS

Figure 1:
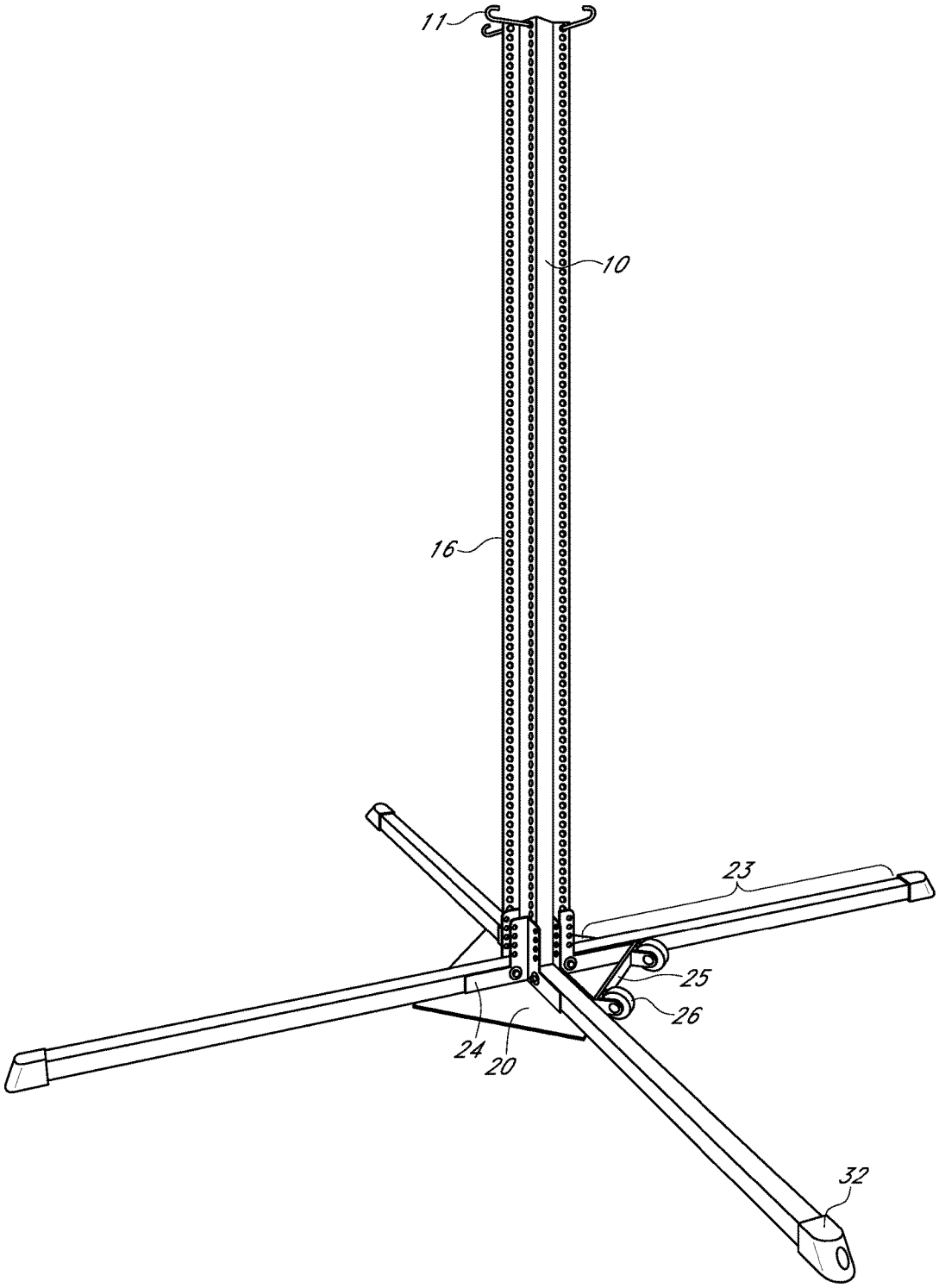
FIG. 1 is a perspective view of a multi-user mobile band station (MMBS) disclosed herein along with detailed call-outs for enablement of the present disclosure.

| Element Description | Element Number |
|---|---|
| Resistance band (existing) | 1 |
| Cushioned soft-grip handle (existing) | 2 |
| Anchor/Clip | 3 |
| Central support stand | 10 |
| Arms | 11 |
| Hook | 12 |
| Perimeter - central support stand | 13 |
| Attachment bar | 16 |
| Adjustment holes | 17 |
| Fasteners (bolts, nuts, screws, etc.) | 19 |
| Base | 20 |
| Base support rod (not shown) | 20a |
| Vertical support rod | 21 |
| Horizontal receiver | 22 |
| Attachment leg | 23 |
| Foldable bracket | 24 |
| Wheel Frame | 25 |
| Wheel | 26 |
| Threaded T-handle | 30 |
| Leveling pad | 31 |
| Foot | 32 |
| Floor (ground) | 40 |
| User | 50 |
| Multi-user Mobile Band Station (MMBS) | 100 |
| Multi-user Mobile Band Station (MMBS) - Perimeter | 101 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Due to its low cost, portability and ease of use, exercises using resistance bands have grown in popularity and have become the leading exercise tool over the past several years. While there are a number of resistance band exercise devices in the market, none of them allows multiple users to exercise at various heights using a single exercise device. A multi-user mobile band station is an exercise device using multiple resistance bands 1 with cushioned soft-grip handles, without any limitation and restriction, therein provides the platform for a wide variety of exercises that requires anchoring to a secured base 20. The present embodiment is comprised of a central support stand 10 with attachment bars 16 and a base with attachment legs. Additional features and advantages of the embodiment is a pair of wheels attached at a side of the base designed to accommodate the transportation of the multi-user mobile band station to different exercise locations. When the multi-user mobile band is in needed for exercise application, the attachment legs may be slid down horizontally into the horizontal receiver at the base for the purpose of structurally supporting the base. When the multi-user mobile band is not in use, the attachment legs may be removed from the horizontal receiver and then be folded vertically around the perimeter of the central support stand to save space, tidy appearance and allow for easy transportation. Another beneficial feature of the multi-user mobile band station is that it enables a single coach to instruct and oversee multiple users positioned around the multi-user mobile band station during exercise improving instruction, saving time and improving athlete compliance with the prescribed workout.

Illustrative Embodiment

Disclosed are components that can be used with at least one embodiment of the disclosed Multi-user Mobile Band Station 100. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all potential embodiments of the Multi-user Mobile Band Station 100. This applies to all aspects of this application including, but not limited to, components of a Multi-user Mobile Band Station 100. Thus, if there are a variety of additional components that can be added it is understood that each of these additional components can be added with any specific embodiment or combination of embodiments of the Multi-user Mobile Band Station 100. The present Multi-user Mobile Band Station 100 may be understood more readily by reference to the following detailed description of preferred embodiments and the examples included therein and to the Figures and their previous and following description.

Figure 3:
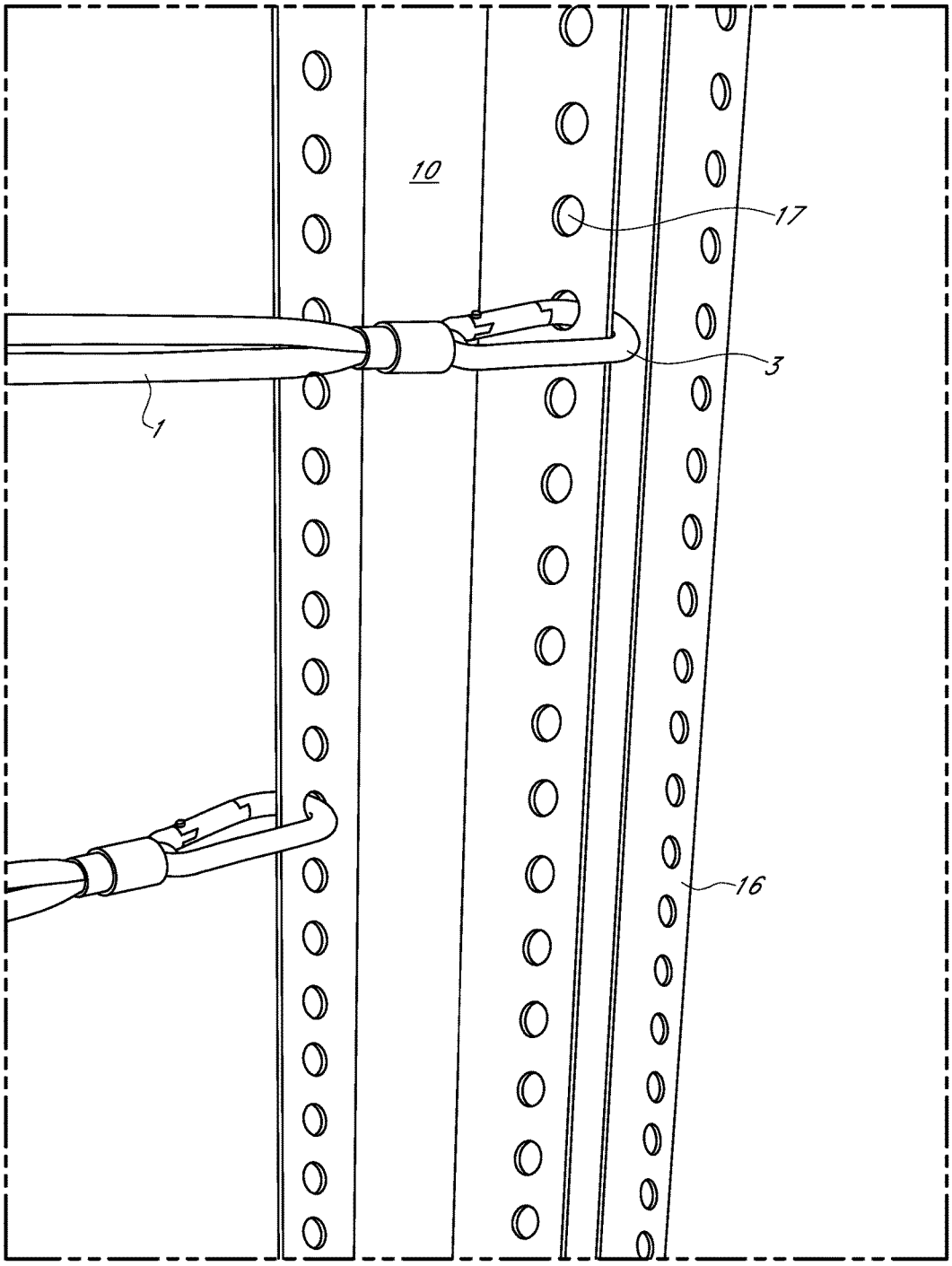
FIG. 3 is a side view of an attachment bar with multiple adjustment holes allowing attachment of multiple resistance band to the multi-user mobile band station at various heights.

FIG. 1 is a perspective view of a multi-user mobile band stand 100 disclosed herein along with detailed call-outs for enablement of the present disclosure. The embodiment of the present invention comprises a central support stand 10 with attachment bars 16 and a base 20 with attachment legs 23. At the top of the central support stand 10, a plurality of arms 11 with hooks 12 are positioned around the perimeter 13 of the central support stand 10 to allow access and engagement of the resistance bands 1 or exercising tools, without any limitation or restriction, during use or storage. FIG. 3 is a side view of an attachment bar 16 with multiple adjustment holes 17 allowing multiple attachment of resistance bands 1 to the multi-user mobile band station 100 at various heights. Multiple attachment bars 16 are attached around the perimeter 13 of the body of the central support stand 10. Six (6) attachment bars 16 are shown but the number may vary, as required for a particular exercise application. In addition, the attachment bar 16 contains multiple adjustment holes 17 along the length of the attachment bar 16 which allows the users 50 to adjust the resistance bands 1 at different height depending on the user's comfort and also depending on the types of exercises. One of ordinary skill will appreciate that having multiple attachment bars 16 around the perimeter 13 of the central support stand 10 allows the user 50 to have the flexibility when exercising at various angles (up to 360 degree) in relation to the position of the multi-user mobile band stand 100, without limitation and or restriction. One of ordinary skill will also appreciate that the adjustment holes 17 on the attachment bar 16 accommodate various heights of the user 50 which makes the embodiment easy and safe to use. Because various heights are allowed, users 50 may be positioned around the perimeter 101 of the multi-user mobile band stand 100 allowing each user 50 to be positioned as comfortable for each user with interference with adjacent users 50 on either side. As embodied herein, the multi-user mobile band stand 100 allows users 50 the freedom to position themselves around multi-user mobile band stand 100 as appropriate allowing them a comfortable space in which to conduct exercises using the resistance bands 1. Although not shown, one of ordinary skill will appreciate that the adjustment holes 17 could be configured directly in the central support stand 10 to allow the concurrent engagement with the plurality of exercise bands in support of exercising.

Figure 2:
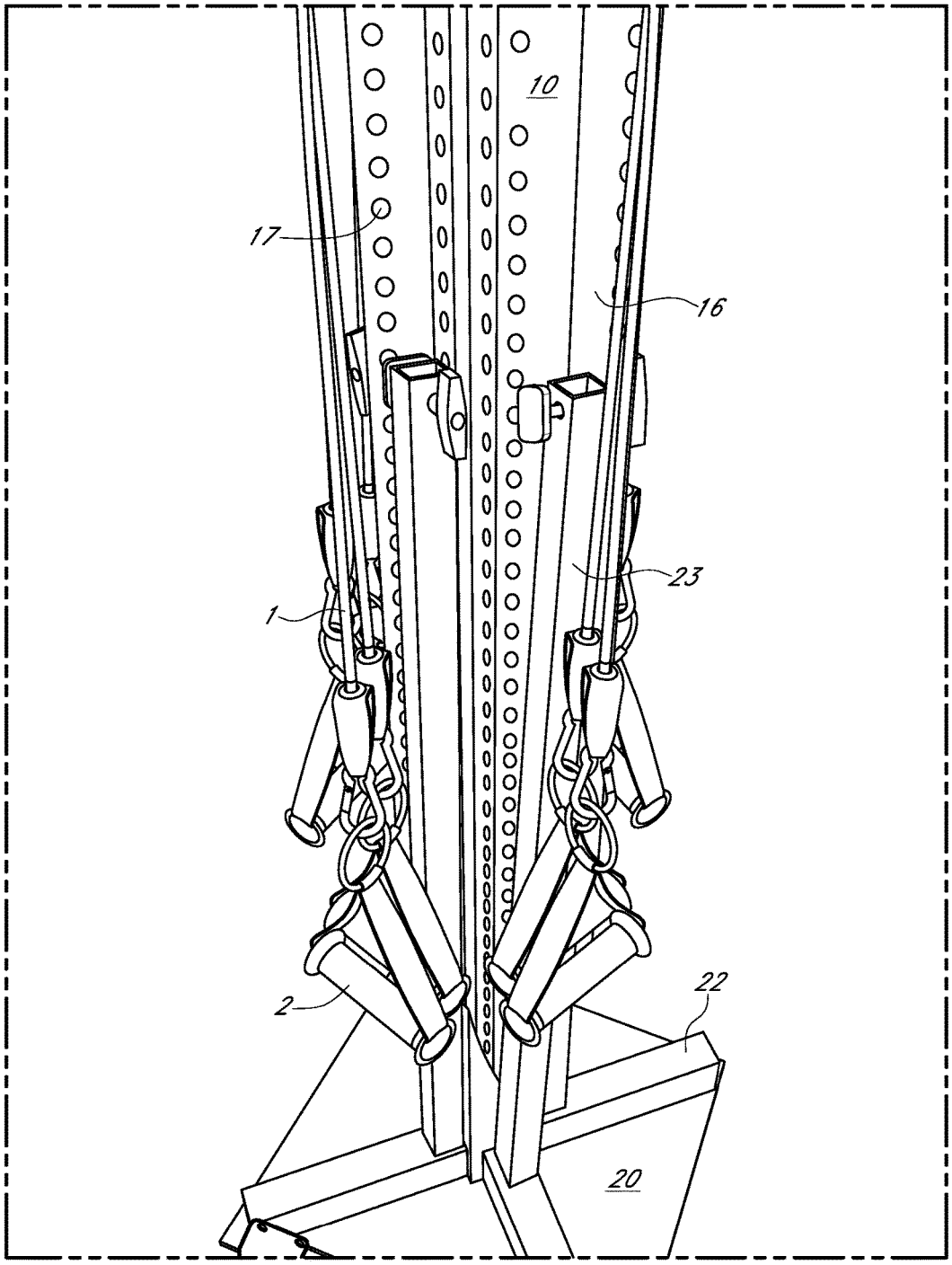
FIG. 2 is a detailed perspective view of a central support stand having foldable attachment legs secured to the perimeter of the central support stand.
Figure 4:
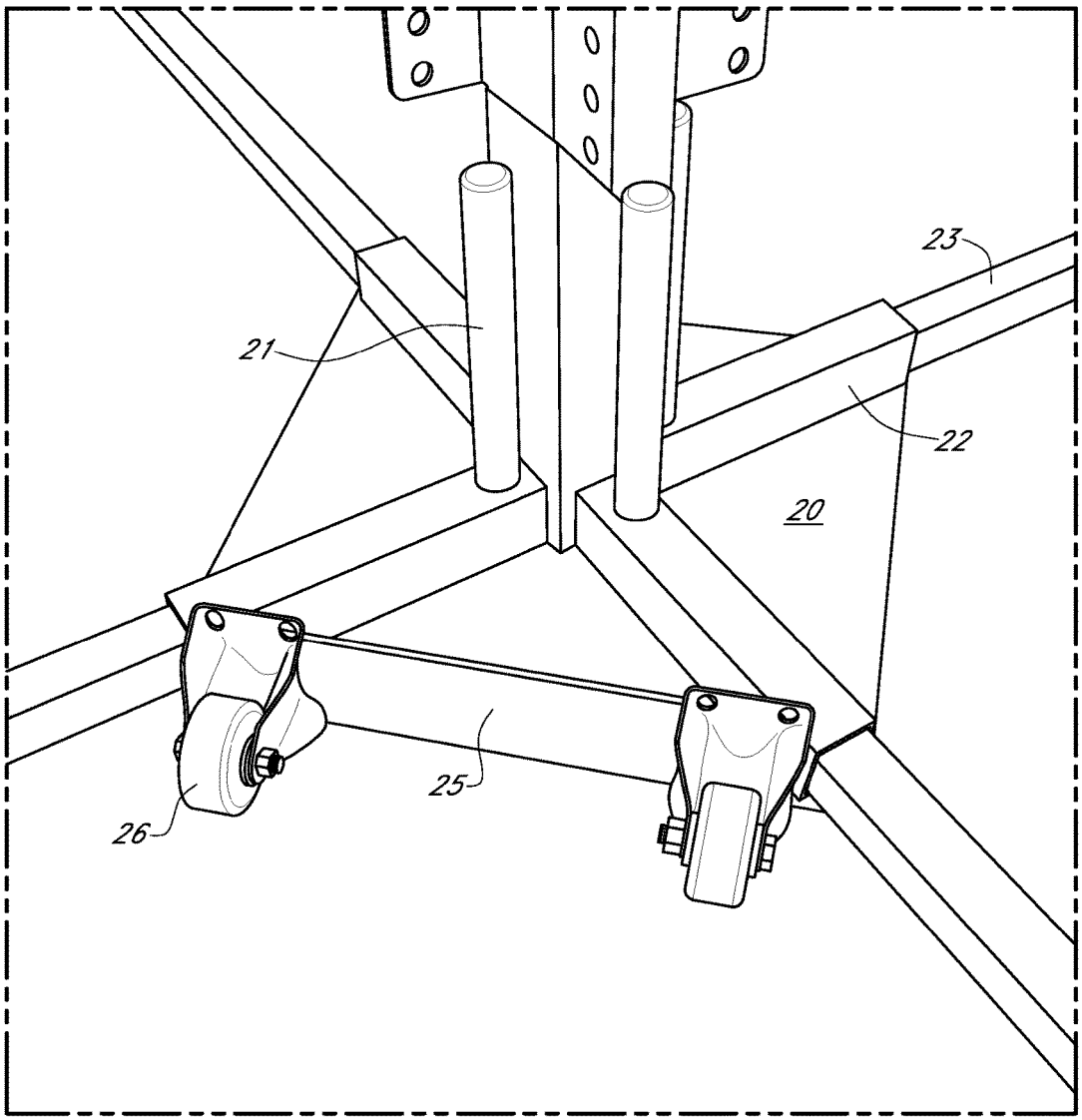
FIG. 4 is a detailed view of a base having a vertical support rod and a horizontal receiver wherein the attachment legs are slid into the horizontal receiver to structurally support the mobile band station.

FIG. 2 is a detailed perspective view of a central support stand 10 having attachment legs 23 structurally secure to the perimeter 13 of the central support stand 10. FIG. 4 is a detailed view of a base 20 having multiple vertical support rods 21 attached around the perimeter 13 of the central support stand 10. The vertical support rod 21 is positioned on a horizontal receiver 22 of the base and is designed for folding the attachment legs 23 during transportation. When the multi-user mobile band station is in use, the attachment legs 23 are removed from the vertical support rods 21 and connect therein to the horizontal receiver 22 to structurally support the MMBS 100. One of ordinary skill will appreciate that the attachment leg 23 is removable and adjustable to structurally support the multi-user mobile band station, subject to a particular need, use or application. As shown in FIG. 1 the attachment leg 23 is hinged via fasteners (nut and bolt) to a foldable bracket 24 mounted on the base 20 to allow the attachment legs 23 to be folded when not in use and deployed for additional support. As shown in FIG. 4, the attachment legs 23 are removable. When deployed, the attachment legs 23 may be slid into the horizontal receiver 22. For transport or storage, the attachment legs 23 may be slid out of the horizontal receiver 22 and slid onto the vertical support rod 21. In addition, the resistance band 1 may be hung to one of the plurality of arms 11 and may be secured to the multi-user mobile band station 100 when not use or during transportation.

Figure 5:
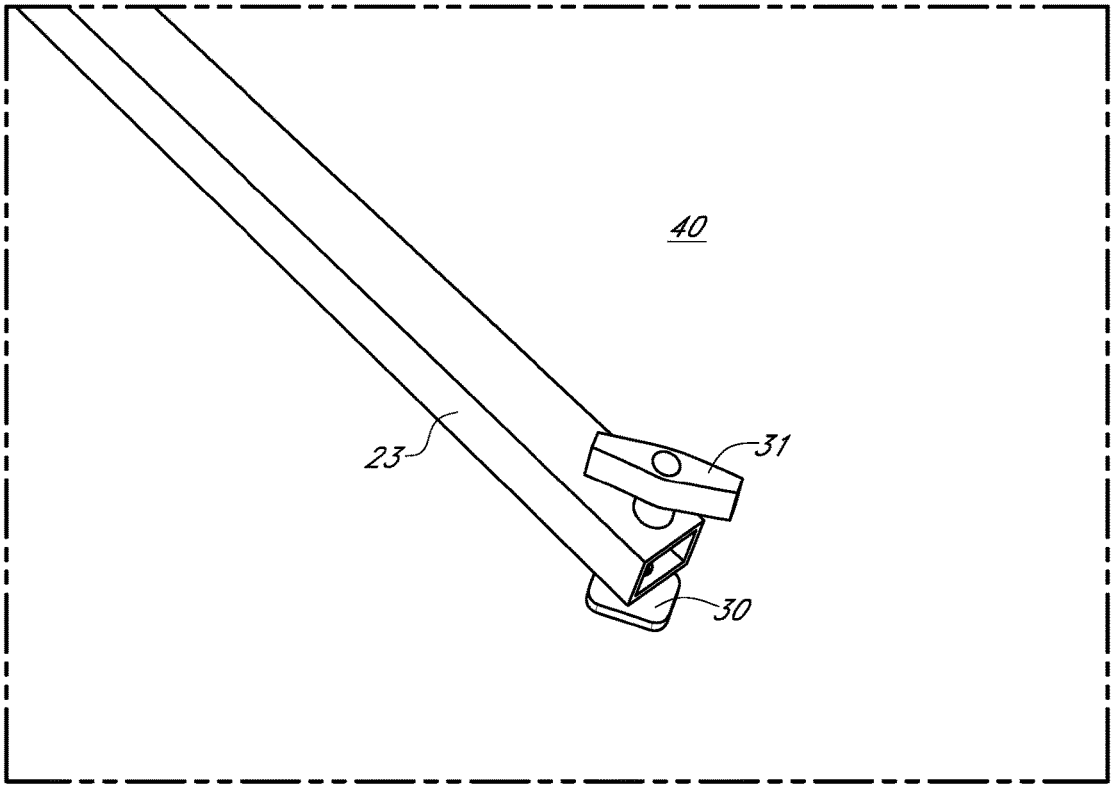
FIG. 5 is an end view of an attachment leg having a threaded T-handle and a leveling pad to structurally secure the leg and support the stand as disclosed in FIG. 4.
Figure 6:
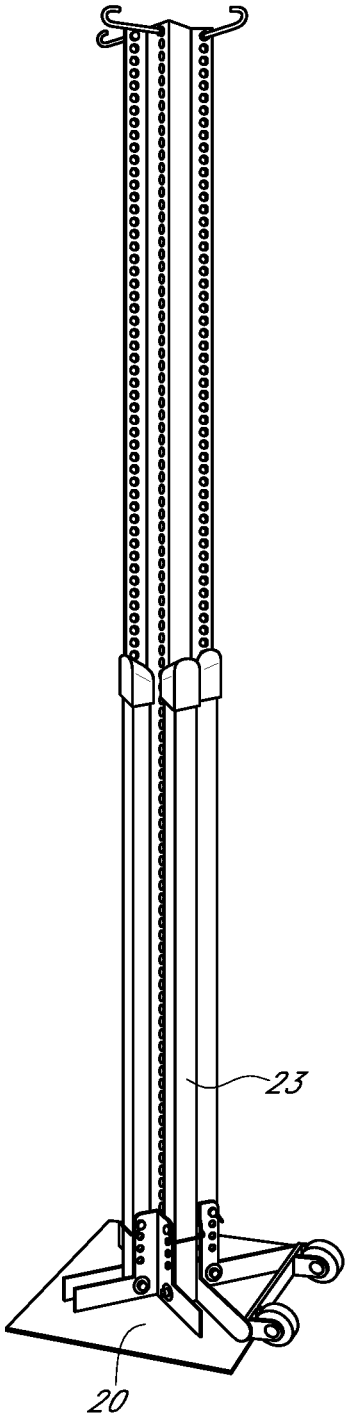
FIG. 6 is a perspective view of another version of the base stand having a foldable bracket designing for folding the attachment legs during transportation.

FIG. 5 is an end view of an attachment leg 23 having threaded T-handle 30 and a leveling pad 31 to structurally secure the attachment legs 23 and support the central stand 10 as disclosed in FIG. 4. One benefit of having threaded T-handle 30 and a leveling pad 31 is to facilitate securing the base 20 and further securing the multi-user mobile band station 100 during exercising, preventing the station from falling or tipping over during use. Another version of the base is illustrated in FIG. 6, a perspective view of the base 20 having a foldable bracket 24 designing for folding the attachment legs 23. Instead of having vertical support rod 21, another alternative design for the base 20 is a foldable bracket 24 affixed to the bottom of the central support stand 10. One benefit of having the foldable bracket 24 is that the attachment legs 23 can be attached permanently to the embodiment so that the attachment legs 23 can be slid up and down dependent on a particular need, use or application.

ILLUSTRATIVE METHOD OF USE

Figure 7:
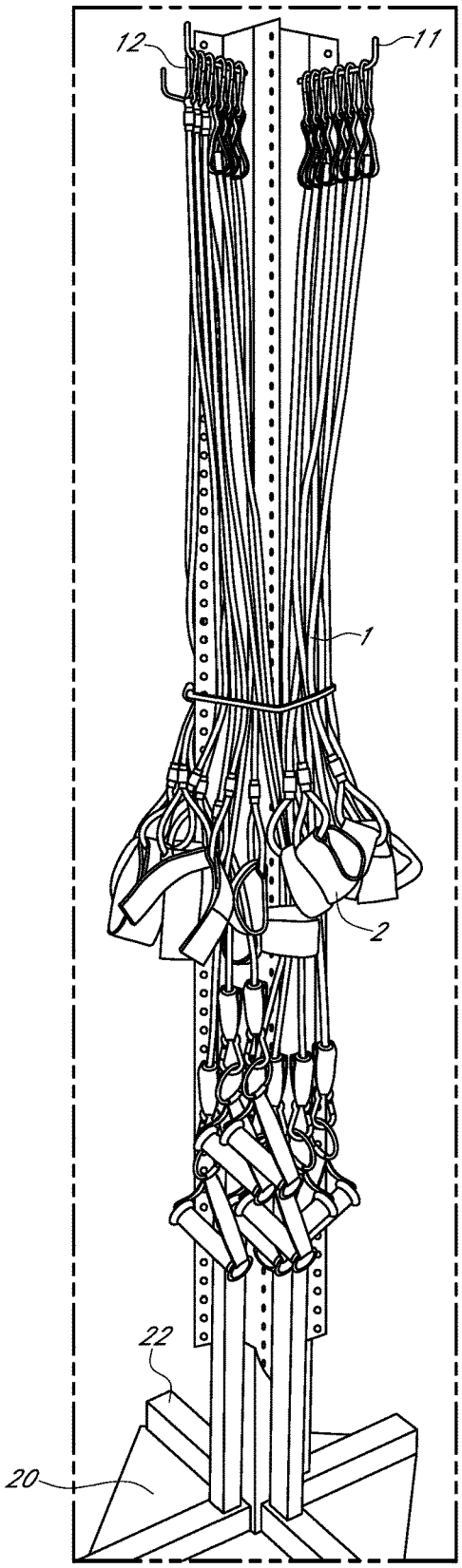
FIG. 7 is a front perspective view of multiple resistance bands and cushioned soft-grip handles attached to multi-user mobile band station as disclosed in FIG. 1 when not in use or in storage.
Figure 8:
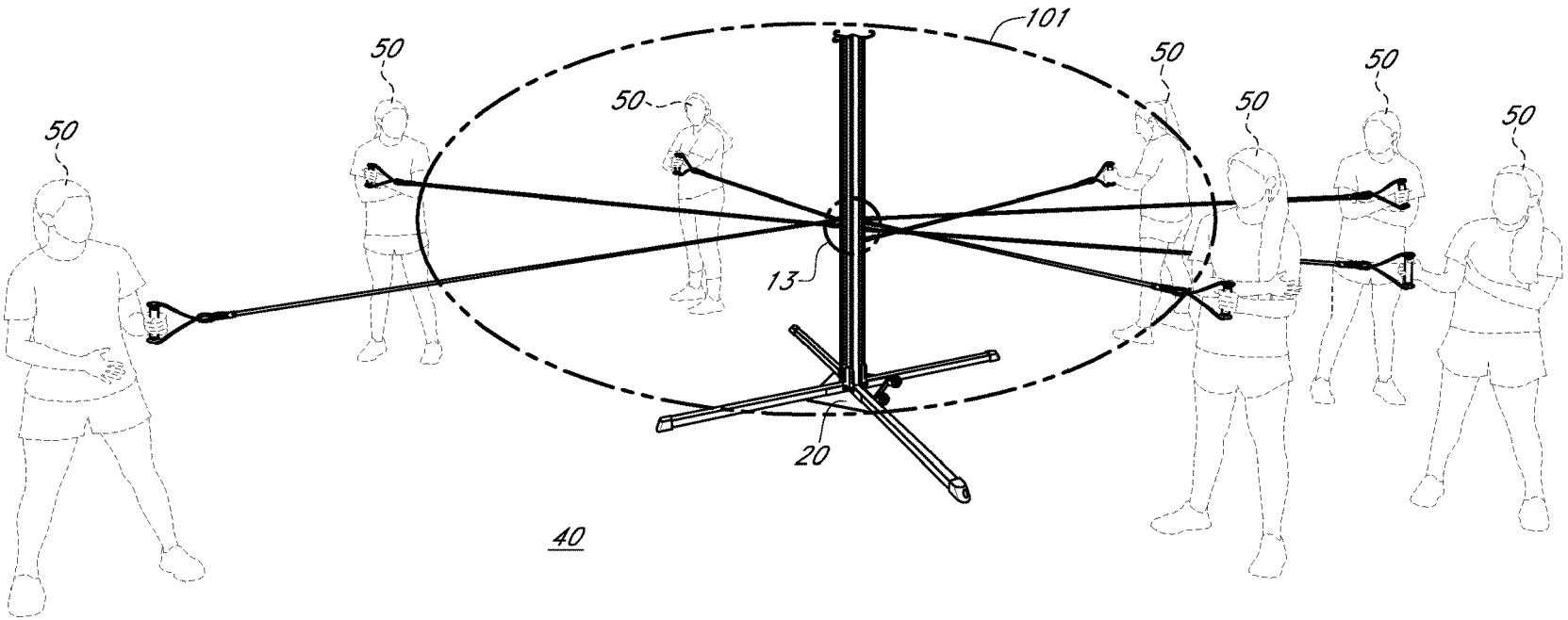
FIG. 8 is a perspective view of multiple users exercising concurrently using a single mobile band station and positioned around the perimeter as described in FIG. 1.
Figure 9:
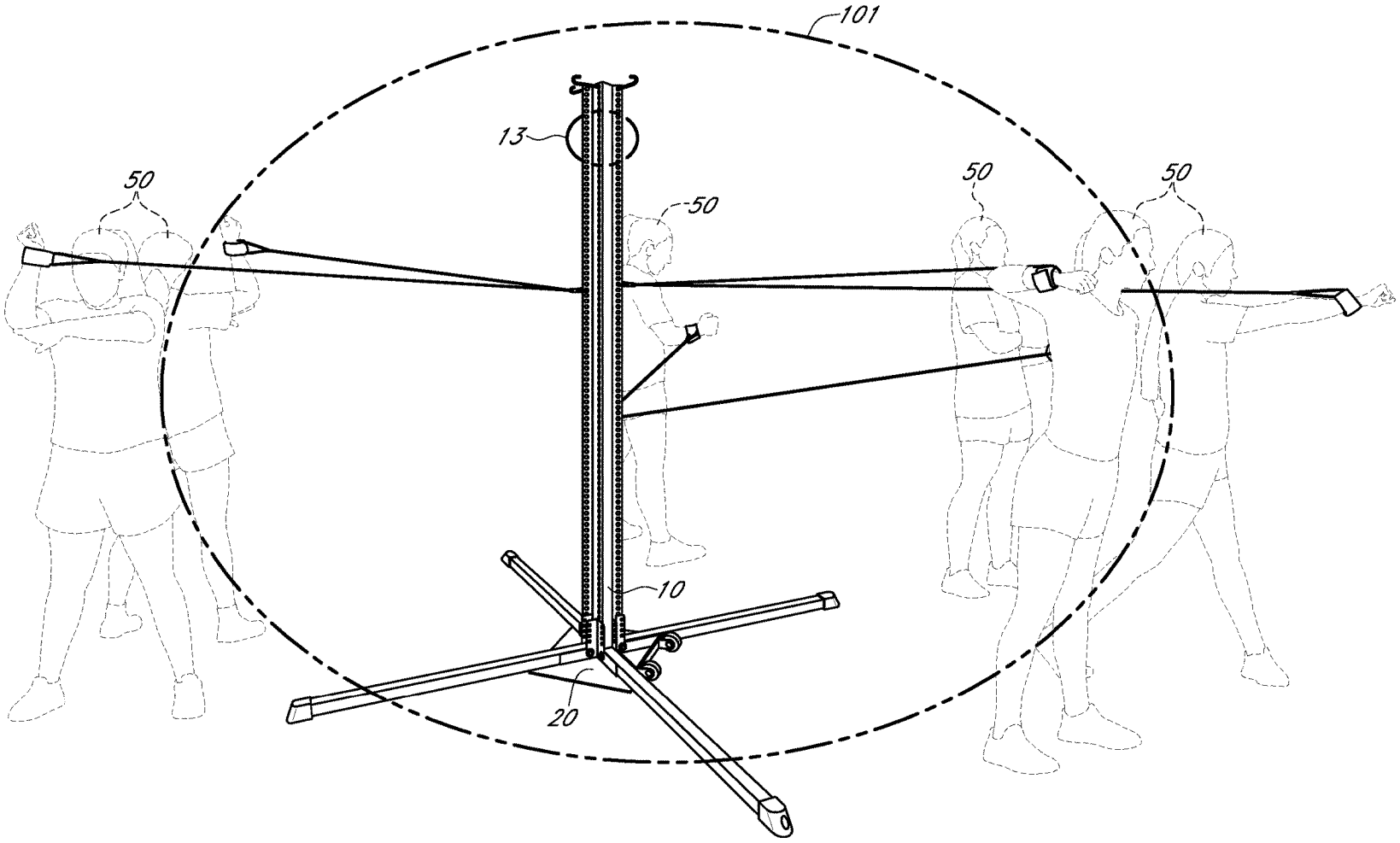
FIG. 9 is another perspective view of multiple users exercising at various heights using a single mobile band station and positioned around the perimeter as illustrated in FIG. 8.

FIG. 7 is a front perspective view of multiple resistance bands 1 and cushioned soft-grip handle 2 attached to multi-user mobile band station 100 as disclosed in FIG. 1. FIG. 8 is a perspective view of multiple users 50 exercising using a single mobile band station 100 as described in FIG. 1. FIG. 9 is another perspective view of multiple users 50 exercising at various height using a single mobile band station 100 as illustrated in FIG. 8. One of ordinary skill will appreciate that the embodiment enables a single coach to instruct and oversee multiple users positioned around the multi-user mobile band station 100 during exercise improving instruction, saving time and improving athlete compliance with the prescribed workout.

In at least one illustrative method of use the present disclosure supports concurrent group exercise using the multi-user mobile band station 100 allowing the positioning of a plurality of users 50 around the perimeter 101 of the multi-user mobile band station 100 having a central support stand 10 with a first end and a second end, the first end of the central support stand 10 further defined as a top end and the second end of the central support stand 10 further defined as a bottom end. The central support stand 10 may be configured with at least one attachment bar 16 also having a first end and a second end, the at least one attachment bar 16 attached to the central support stand 10, the at least one attachment bar 16 having at least two adjustment holes 17 configured for engagement with the first end of the resistance band 1. As previously discussed and shown in FIGS. 1-9, a base 20 having a top surface and a bottom surface is positioned at the bottom end of the central support stand 10 and configured to provide support for the central support stand 10. The first end of the at least one resistance band 1 is then attached to the end of at least one resistance band 1 at one of the at least two adjustment holes 17 positioned in the attachment bar 16 of the multi-user mobile band station 100. The user 50 may then engage with the second end of the at least one resistance band 1 with each user 50 of the plurality of users 50 positioned around the perimeter 101 of the multi-user mobile band station 100 to complete at least one exercise with the at least one resistance band 1 substantially concurrent. The second end of the resistance band 1 may be configured for engagement with the user 50 simply as the band end (see FIG. 10), a t-handle 30 grip or as webbed end see FIG. 11). As disclosed herein, in at least one configuration, the multi-user mobile band station 100 may be used with a resistance band 1 attached to the attachment bar 16 at a different height than the height of another at least one resistance band 1, as dictated by user 50 needs or comfort. Further, MMBS 100 may be configured and used with each user 50 doing the same exercise or each user 50 doing different exercises concurrently. Further, it should be understood that the design allows for an exercise instructor, trainer or coach to position themselves proximate the multi-user mobile band station 100 to monitor the exercise compliance of the users 50 and deliver exercise instructions from the exercise instructor to the users 50 to improve compliance, form and ultimately exercise outcomes.

Additional features and advantages of the embodiment is a pair of wheels 26 attached at a side of the base 20 designed to accommodate the transportation of the multi-user mobile band station 100 to different exercise locations. One of ordinary skill will appreciate that different types and different sizes of the wheels 26 could be used for both outdoor and indoor activities, without any limitation and restriction. For example, and without limitation or restriction, the wheels 26 could be removable with a first set being for indoor use (as shown) and a second set made for "turf" allowing the multi-user mobile band station 100 to be wheeled to an outdoor location, used and then stored inside or outside. (not shown) Unlike the fixed prior art wall-mount system, the mobility of the multi-user mobile band station 100 allows its use by track athletes, baseball and football players during practice or for pre-game warm-up and stretching thereby reducing injury potential for the athlete. Exemplary and illustrative exercises that are allowed by the structure and methods disclosed herein could include, without limitation or restriction, upright rows, band pull aparts, bicep curls, triceps extensions, triceps pushdowns, wrist curls, wrist extensions, front deltoid raises, bent over lateral raises, squat to presses, band crunches, band twisting crunches, trunk rotations, rows, arm extensions, leg extensions, calf raises, ankle eversions, stationary lungse, squats, shoulder presses, shoulder rotation and/or combinations therein.

One of ordinary skill will appreciate that the wheels 26 could be detachable or permanently affixed to the multi-user mobile band station 100 dependent on particular exercise application and any type of wheel could be used, as is suitable for a particular need or application.

Figure 10:
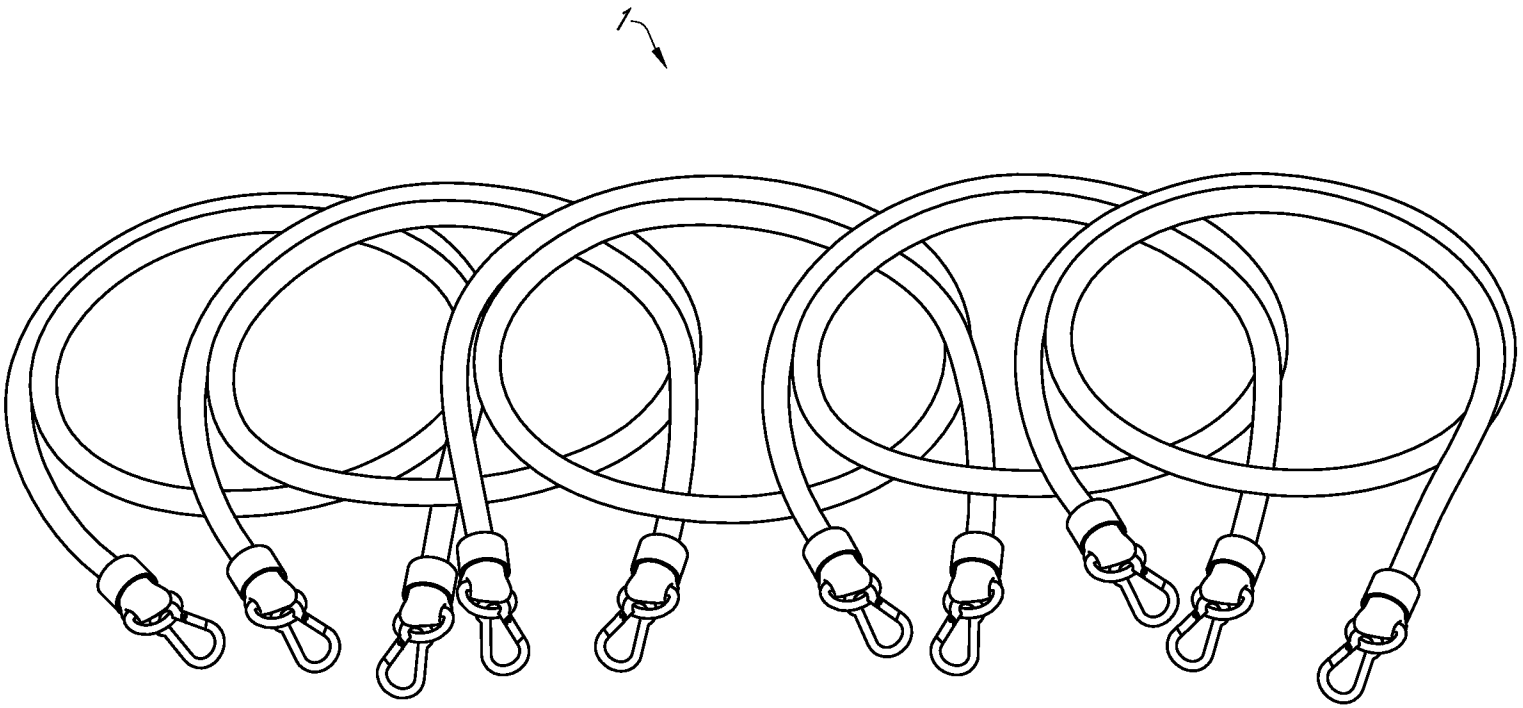
FIG. 10 is a perspective view of a prior art resistance band with anchor to attach to the multi-user mobile band station as disclosed in FIG. 1.
Figure 11:
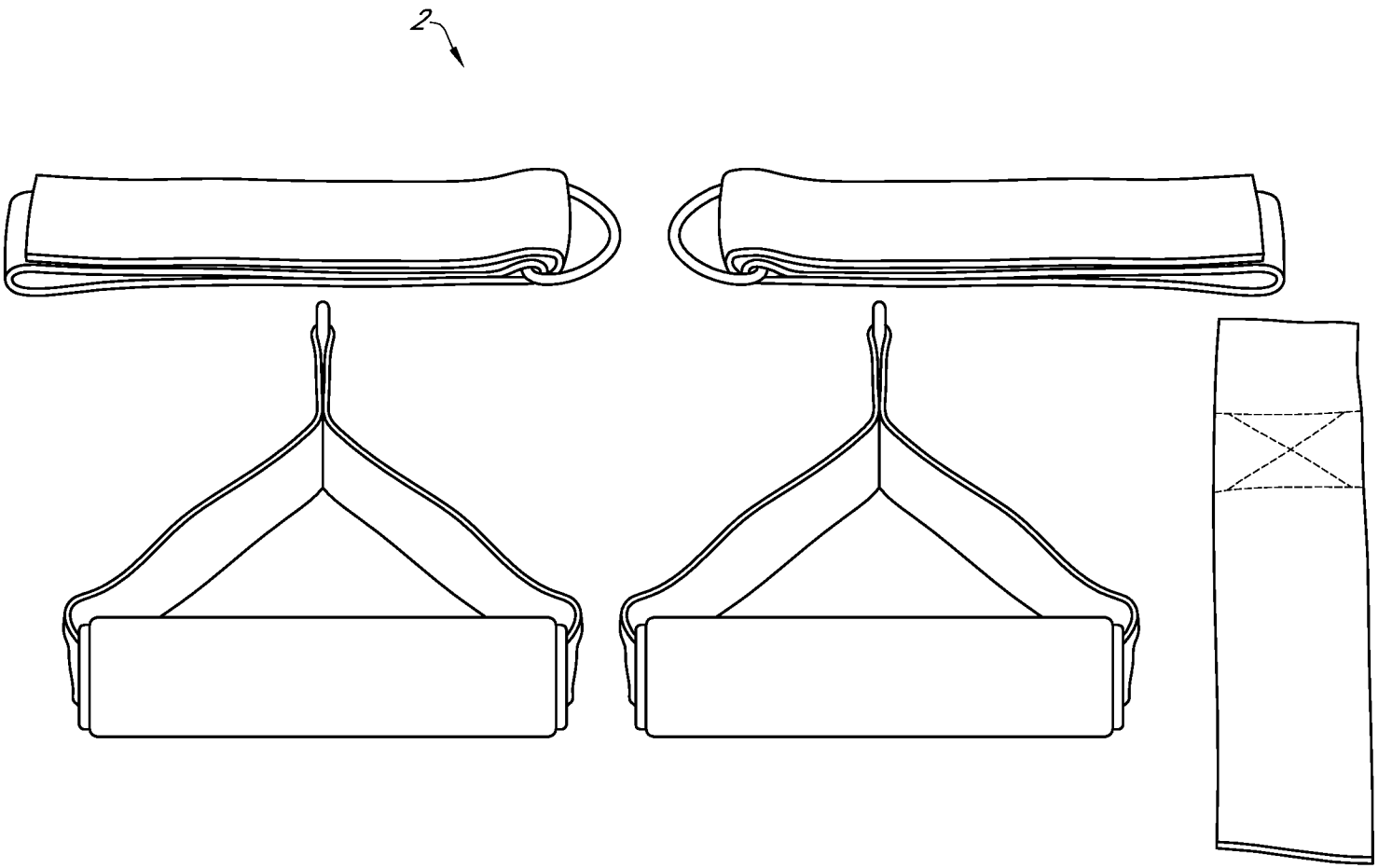
FIG. 11 is a perspective view of cushioned soft-grip handle as found in the prior art to improve the user's grip during exercising as disclosed in FIG. 7.

FIG. 10 is a perspective view of a prior art resistance band 1 with anchor 3 to attach to the multi-user mobile band station 100 as disclosed in FIG. 1. Another beneficial feature of the multi-user mobile band station 100 disclosed is its versatility and compatibility with prior art straps, resistance band 1, or exercise band without any limitation or restriction. The first end of the resistance band 1 may be clipped to the attachment bar 16 via anchor 3 or attached to another non-removable object (not shown). The second end of the resistance band 1 may be clipped or connected to the cushioned soft-grip handle 2 or any exercise handle without any restriction. In FIG. 11, a perspective view of a prior art cushioned soft-grip handle 2 may be grasped in the user's hand. The cushioned soft-grip handle 2 provides softness, comfortability, less friction and consequently, are suitable to perform specific exercises such as hold, pull, grip, etc. without limitation.

Another aspect of the embodiment (not shown) is a base support rod 20*a* which attached permanently to the base 20. The base support rod 20*a* allows the central support stand 10 to be removed from the base 20 during packing and transportation. The central support stand 10 could be re-assembled to the device by slide either inside or outside the base support rod 20*a*. One benefit of this aspect of the embodiment is that every element (central support stand 10, attachment bar base, attachment leg, etc.) of the multi-user mobile band station 100 are detachable which is very convenient when packing, transporting, etc. without any limitation and restriction. Other types of fasteners including hooks, bolts and or pegs could be used without departure from the spirit and intent of the present disclosure to allow for easy detachment or removal of the fastener for disassemble the device.

It is contemplated that in the illustrative embodiment shown in the enclosed figures the Multi-user Mobile Band Station 100 may be constructed of, but not limited to, any metal or combination of metals including bronze, steel and aluminum; plastics or carbon fiber including Kevlar®, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., compressive strength, stability, elasticity, density). This particular embodiment of a Multi-user Mobile Band Station 100 was fabricated from non-heat tempered steel (material grade 50) using laser cutting technology, which is well known to those of ordinary skill in the art. One of ordinary skill will appreciate that the Multi-user Mobile Band Station 100 could constructed by any method known to those in the art including via casting, forging and machining or stamping and punching, without restriction or limitation.

As one of ordinary skill will appreciate the present disclosure is not limited by the means of construction or the materials chosen as other suitable materials, including plastic, steel or aluminum, and combinations therein.

The resistance band 1 can be selected having variety of resistances as required or desired for a particular application. The embodiment includes, but are not limited to, resistance bands 1, suspension straps, stretch straps and/or exercising bands. One of ordinary skill will appreciate that other types of fasteners 19 including hooks, bolts and or pegs could be used without departure from the spirit and intent of the present disclosure, to allow for easy detachment or removal of the fastener for reassemble the attachment legs for a particular application. The multi-user mobile band station 100 is an exercise device that is low cost, save space, tidy appearance, easy for transportation, allows the users 50 to exercise at any location and improve athlete compliance with the prescribed workout.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

"Optional" or "optionally" means that the subsequently described event or circumstance may or may not occur, and that the description includes instances where said event or circumstance occurs and instances where it does not.

As one of ordinary skill will appreciate the present disclosure is not limited by the means of construction or the materials chosen as other suitable materials, including plastic, steel or aluminum, and combinations therein.

It should be noted that Multi-user Mobile Band Station 100 are not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the embodiment. Furthermore, variations and modifications of the foregoing are within the scope of the Multi-user Mobile Band Station 100. It is understood that Multi-user Mobile Band Station 100 as disclosed herein extends to all alternative combinations of one or more of the individual features mentioned, evident from the text and/or drawings, and/or inherently disclosed. All of these different combinations constitute various alternative aspects of the Multi-user Mobile Band Station 100. The embodiments described herein explain the best modes known for practicing the Multi-user Mobile Band Station 100 and will enable others skilled in the art to utilize the same. The claims are to be construed to include alternative embodiments to the extent permitted by the prior art.

What is claimed is:

1. A method of conducting concurrent group exercise using a multi-user mobile band station comprising:

a. positioning a plurality of users around the perimeter of a multi-user mobile band station, the multi-user mobile band station further comprising:
   i. a central support stand having a first and a second end, the first end of the central support stand further defined as a top end and the second end of the central support stand further defined as a bottom end;
   ii. at least one attachment bar having a first and a second end, the at least one attachment bar attached to the central support stand, the at least one attachment bar is aligned along the length of the central support stand, the at least one attachment bar having at least two holes, the at least two holes are fixed at different positions along the length of the attachment bar;
   iii. a base having a top surface and a bottom surface positioned at the bottom end of the central support stand, the base configured to provide support for the central support stand;
b. attaching a first end of at least one resistance band of a plurality of resistance bands to one of the at least two holes positioned in the attachment bar of the multi-user mobile band station; and,
c. engaging a second end of the at least one resistance band with each user of the plurality of users positioned around the perimeter of the multi-user mobile band station to allow each of the plurality of users to complete at least one exercise with at least one resistance band of the plurality of resistance bands substantially concurrently.

2. The method of conducting concurrent group exercise using a multi-user mobile band station according to claim 1, wherein the at least one resistance band attached to the attachment bar is at a height that is different than another at least one resistance band of the plurality of resistance bands attached to the attachment bar.

3. The method of conducting concurrent group exercise using a multi-user mobile band station according to claim 1, wherein the at least one exercise is selected from the group consisting of an upright row, band pull apart, bicep curl, triceps extension, triceps pushdown, wrist curl, wrist extension, front deltoid raise, bent over lateral raise, squat to press, band crunch, band twisting crunch, trunk rotation, rows, arm extension, leg extension, calf raise, ankle eversion, stationary lunge, squat, shoulder press, shoulder rotation and/or combinations therein.

4. The method of conducting concurrent group exercise using a multi-user mobile band station according to claim 1, wherein the at least one exercise selected for at least one user of the plurality of users is the same for each user of the plurality of users.

5. The method of conducting concurrent group exercise using a multi-user mobile band station according to claim 1, wherein the at least one exercise selected for the at least one user of the plurality of users is different for each user of the plurality of users.

6. The method of conducting concurrent group exercise using a multi-user mobile band station according to claim 1, wherein an exercise instructor is positioned proximate the multi-user mobile band station to monitor exercise compliance of the at least one user of the plurality of users and an exercise instruction is deliverable from the exercise instructor.

7. The method of conducting concurrent group exercise using a multi-user mobile band station according to claim 1, wherein the base is configured with a pair of hinged legs which is configured to be deployed for further support of the multi-user mobile band station.

8. The method of conducting concurrent group exercise using a multi-user mobile band station according to claim 1, wherein the attachment bar is configured with a plurality of holes to allow concurrent engagement with a plurality of exercise bands in support of the at least one exercise.

9. A multi-user mobile band station for use in exercising comprising:

a. a central support stand having a first and a second end, the first end of the central support stand further defined as a top end and the second end of the central support stand further defined as a bottom end;

b. at least one attachment bar having a first and a second end, the at least one attachment bar positioned at a side and along the length of the central support stand, the at least one attachment bar having at least two holes, the at least two holes are fixed at different positions along the length of the attachment bar;

c. a base having a top surface and a bottom surface positioned at the bottom end of the central support stand;

d. at least one attachment leg having a first end and a second end, the first end of the at least one attachment leg attached to the base via a foldable bracket and the second end of the at least one attachment leg configured for engagement with a ground or floor surface, the at least one attachment leg configured to provide support for the central support stand;

e. at least one resistance band configured to attach to the at least one attachment bar.

10. The multi-user mobile band station for use in exercising according to claim 9, wherein the at least one attachment leg is a pair of hinged legs is hinged at its first end for connection to the central support stand.

11. The multi-user mobile band station for use in exercising according to claim 10, wherein the foldable bracket has an L-shaped.

12. The multi-user mobile band station for use in exercising according to claim 9, wherein the base is configured with at least one set of wheels to support wheeled transport of the multi-user mobile band station.

13. The multi-user mobile band station for use in exercising according to claim 9, wherein the at least one attachment bar is linearly aligned along the length of the central support stand.

14. The multi-user mobile band station for use in exercising according to claim 10, wherein the at least one resistance band is configured for vertical adjustment by attaching the at least one resistance band along the length of the at least one attachment bar.

15. A multi-user mobile band station for use in exercising comprising:

a. a central support stand having a first and a second end, the first end of the central support stand further defined as a top end and the second end of the central support stand further defined as a bottom end, the central support stand having a first, a second, a third and a fourth side, the first side is perpendicular to the second side, the second side is perpendicular to the third side, the third side is perpendicular to the fourth side;

b. a plurality of attachment bars having a first and a second end, each attachment bar positioned at each respective side and along a length of the central support stand, each attachment bar configured with a plurality of holes along a length of the attachment bar;

c. a base having a top surface and a bottom surface positioned at the bottom end of the central support stand, the top surface of the base having a first, a second, a third and fourth horizontal receiver, the first horizontal receiver is perpendicular to the second horizontal receiver, the second horizontal receiver is perpendicular to the third horizontal receiver, the third horizontal receiver is perpendicular to the fourth horizontal receiver; and, d. a plurality of attachment legs having a first end and a second end, the first end of each attachment leg attached to the base and the second end of each attachment leg engaged with the ground or floor surface, the plurality of attachment legs configured to provide support for the central support stand;

e. at least one resistance band configured to attach to at least one attachment bar of the plurality of attachment bars.

16. The multi-user mobile band station for use in exercising according to claim 15, wherein the at least one attachment bar is linearly aligned along the length of the central support stand.

17. The multi-user mobile band station for use in exercising according to claim 16, wherein the at least one resistance band is configured for vertical adjustment by attaching the at least one resistance band at one of the plurality of holes along the length of the at least one attachment bar of the plurality of attachment bars.

18. The multi-user mobile band station for use in exercising according to claim 15, wherein each horizontal receiver having a first end and a second end is configured to secure the plurality of attachment legs while in use.

19. The multi-user mobile band station for use in exercising according to claim 18, wherein the first end of each attachment leg is configured to slide into each respective horizontal receiver.

20. The multi-user mobile band station for use in exercising according to claim 19, wherein a vertical support rod is positioned on the first end of each horizontal receiver.

* * * * *